US008810406B2

(12) United States Patent
Sell

(10) Patent No.: US 8,810,406 B2
(45) Date of Patent: Aug. 19, 2014

(54) METHOD FOR TRACEABILITY OF GRAIN HARVEST CROP

(75) Inventor: Dennis Sell, Ames, IA (US)

(73) Assignee: AG Leader Technology, Inc., Ames, IA (US)

( * ) Notice: Subject to any disclaimer, the term of this patent is extended or adjusted under 35 U.S.C. 154(b) by 271 days.

(21) Appl. No.: 13/350,240

(22) Filed: Jan. 13, 2012

(65) Prior Publication Data

US 2013/0184859 A1 Jul. 18, 2013

(51) Int. Cl.
*G08B 13/14* (2006.01)

(52) U.S. Cl.
USPC ..... 340/572.8

(58) Field of Classification Search
CPC ..... G08B 13/2434; G08B 13/2462; G06K 2017/0045; G06K 19/04; G06G 10/087; A01D 43/073; G07C 1/00
USPC ..... 340/572.1, 539.13, 572.8, 13.26, 10.1; 235/385, 487
See application file for complete search history.

(56) References Cited

U.S. PATENT DOCUMENTS 6,760,654 B2 * 7/2004 Beck ..... 701/50
7,047,103 B2 5/2006 Hornbaker et al.
7,162,328 B2 1/2007 Hornbaker et al.
7,511,618 B2 * 3/2009 Hornbaker et al. ..... 340/572.1
7,868,768 B2 1/2011 Angell et al.
8,184,005 B2 * 5/2012 Kamel ..... 340/572.1
2001/0029996 A1 * 10/2001 Robinson ..... 141/11
2005/0168345 A1 8/2005 Swafford, Jr. et al.
2005/0197175 A1 9/2005 Anderson
2005/0205674 A1 9/2005 Herrman et al.
2006/0004484 A1 1/2006 Hornbaker et al.
2008/0300712 A1 * 12/2008 Zachmann ..... 700/116
2009/0266891 A1 10/2009 Santucci et al.

OTHER PUBLICATIONS

AG Leader Technology, Inc., PCT/US0013/21196 filed Jan. 11, 2013, "Notification of Transmittal of the International Search Report and the Written Opinion of the International Searching Authority, or the Declaration" mailed Mar. 26, 2013.

* cited by examiner

*Primary Examiner* — Phung Nguyen
(74) *Attorney, Agent, or Firm* — McKee, Voorhees & Sease

(57) ABSTRACT

A tracking device for assisting in traceability of grain includes a plastic body, an RFID chip disposed within the plastic body, and a weight comprised of a ferromagnetic material disposed within the plastic body. A method provides for dispensing tracking devices into a stream of grain so as to associate identifying information with the stream of grain. A system includes a dispensing device configured to singulate and dispense tracking devices into a flow of grain.

47 Claims, 3 Drawing Sheets

METHOD FOR TRACEABILITY OF GRAIN HARVEST CROP

FIELD OF THE INVENTION

The present invention relates to grain, and more particularly the traceability of grain.

BACKGROUND OF THE INVENTION

With the advent of mainstream genetically modified organism (GMO) crops, GMO based specialty crops, and the growth in Organic farming, more and more interest has been raised the area of crop traceability. Crops of one type grown too close to crops of a different type may become contaminated by genetic material from the incompatible crops grown nearby. The ultimate in this regard, would be to be able to trace an individual kernel of grain to an accurate geo-referenced point where it was grown. Obviously this is impractical in the world today. However, traceability in some form is practical today.

One way this can be done today using detailed record keeping and strict product segregation. It is very practical today to record the region in each field where a load of product comes from and trace that product through delivery systems to their destination. However, it requires a tradeoff. It is not practical to segregate each load of product all the way through the delivery chain to a destination. So loads or regions must be combined and segregated at a much larger unit size. Even this provides difficulties as multiple containers are emptied into much larger containers and those are split between much smaller containers. As this occurs, the ability to accurately tell all of the possible sources for a container of product becomes more difficult and less precise.

To better understand the difficulties involved, consider this realistic scenario for corn distribution. A farmer harvests three fields of corn. Each hopper of corn is dumped into a grain cart and that is in turn dumped into a truck along with other cart loads of grain and hauled to the farmstead. Loads from field A and half of field B are hauled in one truckload and loads from the other half of field B and all of field C are hauled in another truckload. These two truckloads of grain are dumped into a holding bin at the farmstead along with other loads of grain. The grain is then dried and placed into another bin along with the loads of grain harvested from 10 other fields.

Then two truckloads are hauled from this bin to the elevator and sold. The elevator transfers this grain to a silo that also contains loads of grain from 30 other farmers. At a later point in time, the grain elevator sells 50 percent of this grain and it is loaded into 10 rail cars and delivered to a river port. At the river port these rail cars are loaded onto three barges along with grain from four other elevators. These barges travel down the Mississippi river to the gulf. There they are loaded onto a cargo ship along with the grain from forty other barges. The cargo ship travels to Japan and is unloaded into a storage facility. The grain is then shipped by truck to six different endpoints. This illustrates the difficulties involved. The problem is: how can one determine where the delivered grain came from?

Today with good record keeping, one can determine that a specific truckload delivered may have come from one or more of the 70,000 or more locations that fed into the supply chain. With more intense record keeping, one may be able to record the individual combination and division of product and provide a very crude probability of a given source being in the delivery based on a random distribution of product.

In the fully traceable world, the recipients of the grain would be able to tell the various sources and locations of the grain they received. In the world today, this can be tracked by transaction based record keeping, but it has two weaknesses. First, is the need to divide the loads into small enough amounts or areas that the records contain enough precision to be useful. As the loads are made smaller to provide more precision, the record keeping increases. The second issue is that the only thing one can know about the amount of a potential source (load) that gets included in a split between several containers is either based on an even distribution of product in the large container or based on performing dynamic flow calculations on the containers. With storage facilities that have stirators an even distribution may be more accurate. In others, performing some form of flow analysis may be more accurate.

What is needed are new methods, systems, and apparatuses which provide for tracing grain in an accurate and convenient manner.

SUMMARY OF THE INVENTION

Therefore, it is a primary object, feature, or advantage of the present invention to improve over the state of the art.

It is a further object, feature, or advantage of the present invention to provide for methods and systems to provide for traceability of grain which allow for accurate records to be maintained.

A still further object, feature, or advantage of the present invention is to provide for methods and systems to provide for traceability which are convenient to use.

One or more of these and/or other objects, features, or advantages of the present invention will be apparent from the specification. No single embodiment of the present invention need exhibit each and every object, feature, or advantage.

According to one aspect, a tracking device for assisting in traceability of grain is provided. The tracking device includes a plastic body, an RFID chip disposed within the plastic body, and a weight comprised of a ferromagnetic material disposed within the plastic body.

According to another aspect, a system for grain traceability is provided. The system includes a plurality of tracking devices for assisting in traceability of the grain, each of the tracking devices including a plastic body, an RFID chip disposed within the plastic body, and a weight formed of a ferromagnetic material disposed within the plastic body. The system further includes a dispensing device configured to singulate and dispense each of the tracking devices into a flow of grain.

According to another aspect, a method for tracing grain is provided. The method includes providing a plurality of tracking devices for assisting in traceability of the grain, each of the tracking devices including a plastic body, an RFID chip disposed within the plastic body, and a weight comprised of a ferromagnetic material disposed within the plastic body. The method further includes dispensing at least one of the plurality of tracking device into a stream of grain so as to associate identifying information with the stream of grain.

DETAILED DESCRIPTION OF THE PREFERRED EMBODIMENTS

The present invention provides for the use of RFID tags or chips in grain handling to provide for improved tracking.

Figure 1:
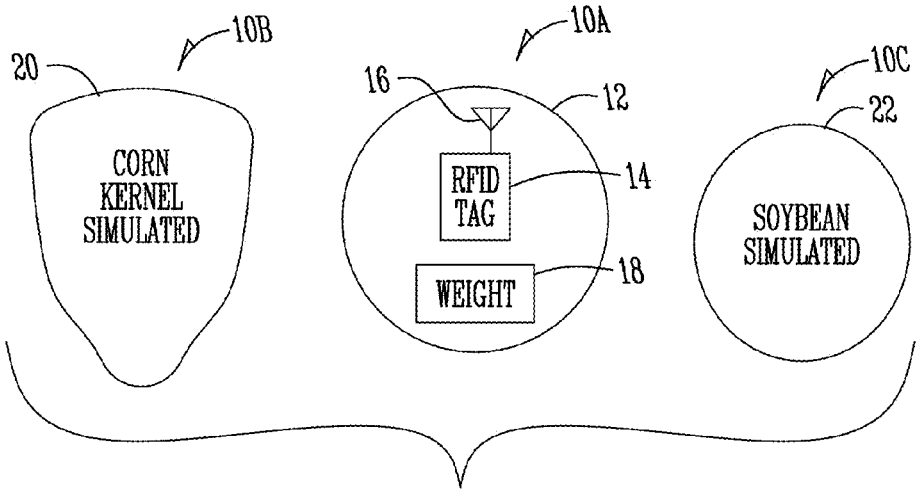
FIG. 1 illustrates various embodiments of a tracking device.

FIG. 1 illustrates various embodiments of the tracking device of the present invention. As shown in FIG. 1, there is a tracking device 10A. The tracking device 10A can include a housing 12 in the form of a small plastic ball with a body enclosing an RFID tag 14. The RFID tag 14 is electrically connected to an antenna 16. Also disposed within the body is a weight 18. The weight 18 is preferably formed of a ferromagnetic material such as steel. The weight preferably has a mass which gives the overall mass of the tracking device 10A approximately the same mass as a grain. For example, where the tracking device 10A is to be used to track corn, the tracking device 10A may have an overall mass which approximates a kernel of the corn. Thus, where grains of corn weigh approximately 1 gram, the tracking device may be constructed to weigh approximately 1 gram so that the mass of the tracking device approximates the mass of the kernel of corn. Similarly, where the tracking device 10A is to be used to track soybeans, the tracking device 10A may have an overall mass which approximates a soybean. Where the weight 18 is formed of a ferromagnetic material such as steel, another benefit provided is that the tracking device can be separated from a flow of grain through use of a magnetic field.

In addition to the tracking device 10A having a mass that approximates a single grain, the tracking device 10A may have other physical characteristics which simulate a grain. These may include size, surface texture, coefficient of friction, as well as mass. By simulating the physical characteristics of a grain, the tracking device 10A has the same flow characteristics and mass of the device would be manufactured to match the characteristics of the particular grain being harvested. This may provide the device with the same or similar flow characteristics as the grain.

In one embodiment, a tracking device 10B is wedge-shaped to simulate the shape of a kernel of corn. The tracking device 10B has a texture simulating the texture of a kernel of corn, a density approximately equal to the density of a kernel of corn, and a coefficient of friction approximately equal to the coefficient of friction of the surface of a kernel of corn. These physical characteristics are preferably within ranges which result in the tracking device 10B having the same flow characteristics as kernels of corn in which the tracking device 10B is introduced.

In another embodiment, a tracking device 10C is generally spherical to simulate the shape of a soybean. The tracking device 10C has a texture simulating the texture of a soybean, has a density approximately equal to the density of the soy bean, and a coefficient of friction approximately equal to a coefficient of friction of the grain. These physical characteristics are preferably within ranges which result in the tracking device 10C having the same flow characteristics as soybeans in which the tracking device 10C is introduced.

The RFID tag 14 has a machine readable memory or a non-transitory machine readable medium which may store information associated with grain traceability. This information may include an identifier, a location at which the tracking device was dispensed, a time and date at which the tracking device was dispensed. Of course the information may include other identifying information which may be useful for grain traceability purposes.

Figure 2:
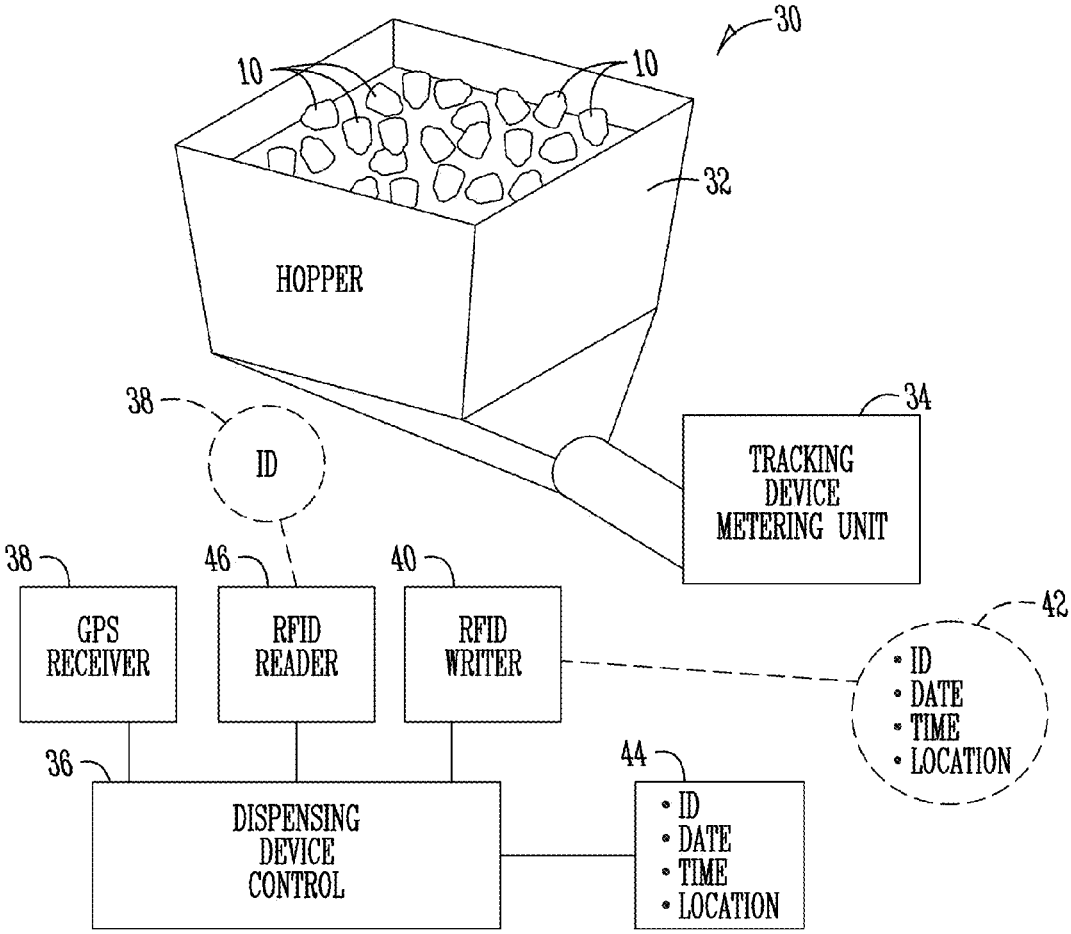
FIG. 2 illustrates a dispensing system for dispensing tracking devices.

FIG. 2 illustrates on example of a dispensing system 30. As shown in FIG. 2, tracking devices 10 may be placed in hopper 32 which feeds a tracking device metering unit 34. The tracking device metering unit 34 provides one example of a device which may be used for singulating tracking devices 10 and placing the tracking devices into a grain flow. The grain flow may be associated with a harvesting machine or with a grain auger. A tracking device metering unit may be of the type used in the planter, except modified to provide for metering the tracking devices in a manner useful for providing grain traceability.

At the time a tracking device is dispensed into a product flow stream or grain flow stream, the identifier associated with the tracking device may be recorded. In addition, other information associated with the device may be recorded including the date, time, location (such as GPS location) associated with the dispensing of the tracking device or with the grain in which the tracking device is dispensed. In one embodiment, an RFID reader 46 may be used to read the ID 48 of each tracking device 10 as it is dispensed. This identifier and other information such as date, time and location may then be stored in database 44. According to another embodiment, an RFID writer 40 may store information on the RFID tag 10 as it is being dispensed. This information may include an ID, date, time, location or other information 42.

The metering rate may be adjusted by area covered or volume of product flow and the amount of accuracy required. By using statistical analysis a dispensing rate can be determined to provide a range of accuracy. (e.g. 80% within 1000 ft.). The targeted accuracy may be varied across the field to provide more accuracy where the crop borders an incompatible crop and less accuracy further away from incompatible crops. This can be performed by means of a prescription map or by examining field boundaries. Thus, it should be apparent that the present invention contemplates that metering may be adjusted in a number of different ways.

Figure 3:
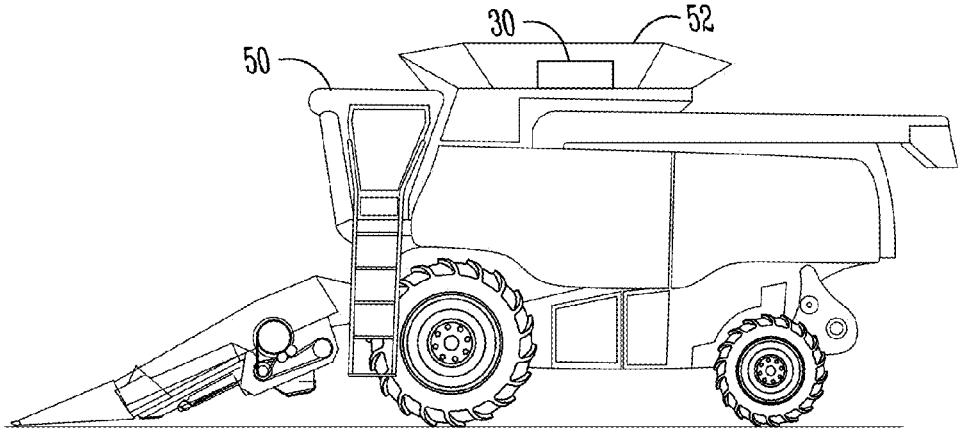
FIG. 3 illustrates placement of the dispensing system on a harvesting machine.
Figure 4:
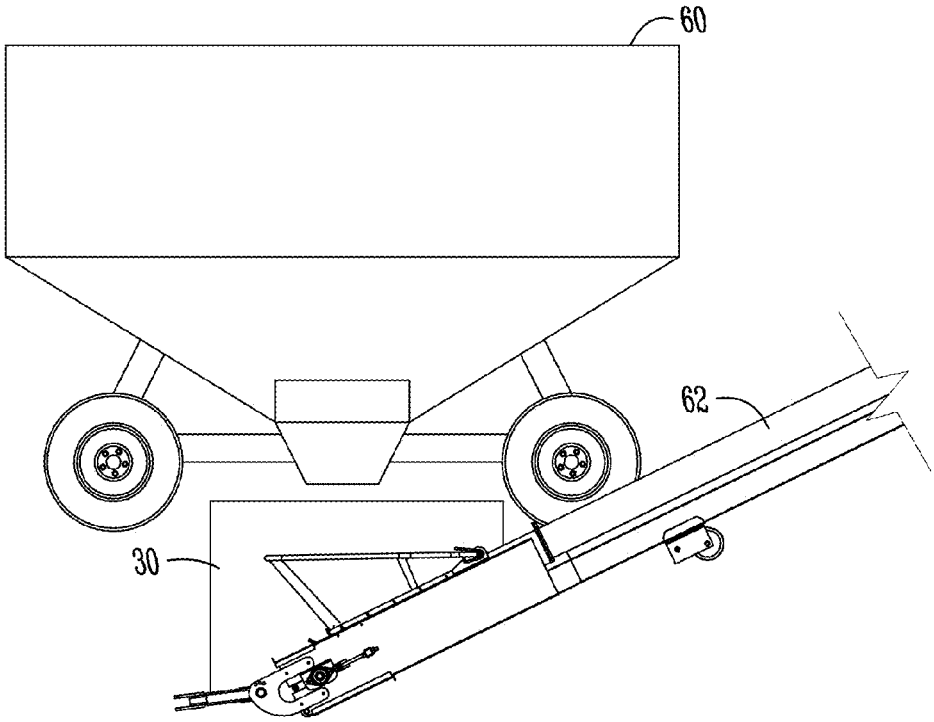
FIG. 4 illustrates placement of the dispensing system on a grain auger such as a grain auger.

The dispensing device 30 may be located in any number of places within a supply chain. As shown in FIG. 3, the dispensing device 30 may be located on a harvesting machine 50 to periodically dispense tracking devices into a grain flow stream flowing into the grain tank 52 of the combine. As shown in FIG. 4, the dispensing device 30 may be located at a grain auger 62, such as one used to unload a gravity flow grain wagon 60.

It is to be understood that different information may be associated with a tracking device based on the type of grain, where the dispensing device is located, and the type of information which is of interest. It is to be further understood that tracking devices may be introduced at multiple locations along a supply chain of the grain to provide information not only about the origin of the grain but to provide additional information about its travel through the supply chain.

It is to be further understood that any point along the supply chain, an RFID reader may be placed to collect information about the grain at that step. This information may be stored within a database. In addition, an RFID writer may be placed at any point along the supply chain to write additional information to the RFID tag regarding the movement of grain through a supply chain.

Figure 5:
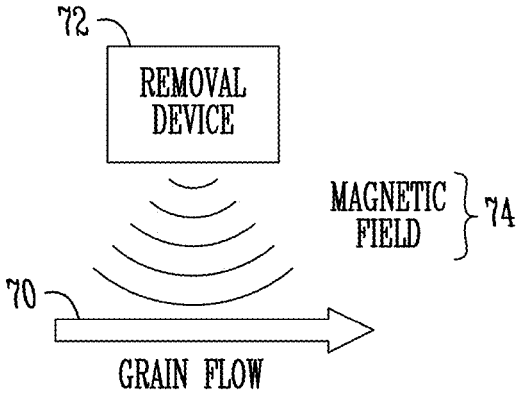
FIG. 5 illustrates one example of a removal device for removing tracking devices from grain flow.

The tracking devices may be removed from the grain flow in various ways. FIG. 5 illustrates a preferred setup for removing tracking devices. In FIG. 5, a removal device 72 is placed proximate grain flow. The removal device 72 may include a magnet or electromagnet configured to generate a magnetic field 72. Where the tracking devices include a ferromagnetic mass, such as a steel ball, the removal device 72, through the magnetic field, exerts a physical force on the tracking devices but not the grain to separate the tracking devices from the grain.

Figure 6:
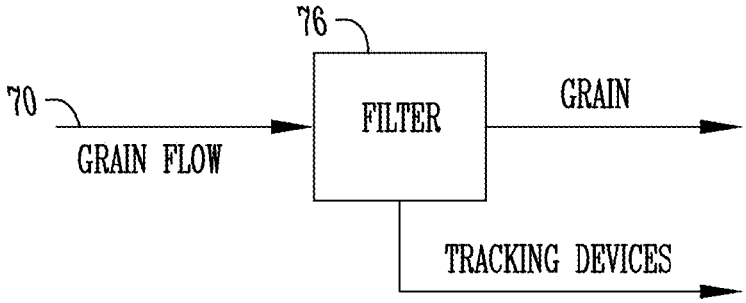
FIG. 6 illustrates another example of a removal device for removing tracking devices from grain flow.

In FIG. 6, one or more filters 76 are used as the removal device to filter the tracking devices from the grain in various ways such as size or shape. As previously explained the use of the ferromagnetic mass is generally preferably to the use of filters where the tracking device has the same size, shape, and other characteristics as the grain.

Therefore a tracking device and methods for providing for the traceability of grain have been disclosed. The present invention contemplates numerous variations, options, and alternatives as may be desirable for a particular type of crop, to provide a particular level of accuracy, or otherwise.

What is claimed is:

1. A system for assisting in traceability of grain, the system comprising:

a plurality of tracking devices, each of the tracking devices comprising a plastic body and an RFID chip disposed within the plastic body;

a dispensing device configured to singulate and dispense each of the tracking devices into a flow of grain;

a database stored on a non-transitory computer readable storage medium;

wherein the dispensing device is configured to record information comprising an identifier of each of the tracking devices, location, date, and time of dispensing each of the tracking devices and store the information in the database.

2. The system of claim 1 further comprising a weight comprised of a ferromagnetic material disposed within the plastic body of each of the plurality of tracking devices.

3. The system of claim 2 wherein the weight comprises steel.

4. The system of claim 1 wherein the grain is corn and wherein the plastic body is wedge-shaped to simulate shape of a kernel of corn.

5. The system of claim 1 wherein the grain is soybean and wherein the plastic body is generally spherical to simulate shape of a soy bean.

6. The system of claim 1 wherein the plastic body is shaped to simulate the grain.

7. The system of claim 1 wherein the tracking device has a mass approximately equal to mass of the grain.

8. The system of claim 1 wherein the plastic body has a texture, the texture simulating texture of the grain.

9. The system of claim 1 wherein the tracking device has a density approximately equal to a density of the grain.

10. The system of claim 1 wherein the plastic body has a coefficient of friction approximately equal to a coefficient of friction of the grain.

11. The system of claim 1 wherein the RFID chip includes information stored on a non-transitory machine readable medium.

12. The system of claim 11 wherein the information comprises an identifier, a location of dispensing, and a time and date of dispensing.

13. The system of claim 1 wherein the dispensing device is configured to dispense the plurality of tracking devices based on field location of a harvesting machine providing the flow of grain.

14. The system of claim 1 wherein the dispensing device is configured to dispense the plurality of tracking devices based on rate per area covered by a harvesting machine providing the flow of grain.

15. A system for grain traceability, the system comprising:

a plurality of tracking devices for assisting in traceability of the grain, each of the tracking devices comprising (a) a plastic body, and (b) an RFID chip disposed within the plastic body;

a dispensing device configured to singulate and dispense each of the tracking devices into a flow of grain;

wherein the dispensing device is configured to record information comprising an identifier of each of the RFID chips, location, date, and time of dispensing each of the RFID chips and store the information in a database.

16. The system of claim 15 therein each of the tracking devices further comprises a weight comprised of a ferromagnetic material disposed within the plastic bag.

17. The system of claim 15 wherein the dispensing device is configured to record the identifier of each of the RFID chips, the location, the date, and the time of dispensing on the RFID chip.

18. The system of claim 15 wherein the dispensing device further comprises an RFID writer to record information on the RFID chip of each of the tracking devices.

19. The system of claim 15 wherein the dispensing device further comprises a hopper for holding the plurality of tracking device.

20. The system of claim 15 wherein the dispensing device further comprises a metering device used to singulate and dispense each of the tracking devices into the flow of grain.

21. The system of claim 20 wherein the intelligent control is configured to control the dispensing device to dispense the plurality of tracking devices based on distance traveled by a harvesting machine providing the flow of grain.

22. The system of claim 20 wherein the intelligent control is configured to control the dispensing device to dispense the plurality of tracking devices based on rate per amount of grain flow.

23. The system of claim 20 wherein the dispensing device is configured to dispense the plurality of tracing devices based on field location of a harvesting machine providing the flow of grain.

24. The system of claim 15 further comprising an intelligent control operatively connected to the dispensing device.

25. The system of claim 24 wherein the intelligent control is configured to control the dispensing device to dispense the plurality of tracking devices based on rate per area covered by a harvesting machine providing the flow of grain.

26. The system of claim 15 further comprising a removal device configured for removing the plurality of tracking devices from the grain.

27. The system of claim 26 wherein the removal device comprises a magnet.

28. The system of claim 26 wherein the removal device comprises an electromagnet.

29. The system of claim 26 wherein the removal device comprises a screen.

30. A method for tracing grain, the method comprising:

providing a plurality of tracking devices for assisting in traceability of the grain, each of the tracking devices comprising (a) a plastic body, and (b) an RFID chip disposed within the plastic body, the RFID chi storm an identifier;

providing a dispensing device configured to singulate and dispense each of the plurality of tracking devices into a flow of grain, wherein the dispensing device is configured to record information comprising the identifier of each of the plurality of RFID chips, location, date, and time of dispensing each of the plurality of RFID chips and store the information in a database;

dispensing at least one of the plurality of tracking device into a stream of grain so as to associate the identifier with the stream of grain; and recording by the dispensing device and into the database, the information comprising the identifier of each of the plurality of RFID chips, the location, the date, and the time of dispensing each of the plurality of RFID chips.

31. The method of claim 30 wherein each of the tracking devices further comprises a weight comprised of a ferromagnetic material disposed within the plastic body.

32. The method of claim 30 further comprising recording location information in the RFID chip.

33. The method of claim 30 further comprising recording timestamp information in the RFID chip.

34. The method of claim 30 further comprising reading the RFID chip to determine information about the grain.

35. The method of claim 34 wherein the information is origin or age of the grain.

36. The method of claim 30 further comprising determining a time to dispense the tracking device and wherein the dispensing occurs at the time.

37. The method of claim 30 further comprising determining a location at which to dispense the tracking device and wherein the dispensing occurs at the location.

38. The method of claim 30 further comprising removing the at least one of the plurality of tracking devices.

39. The method of claim 38 wherein the removing is performed using a magnet.

40. The method of claim 38 wherein the removing is performed using an electromagnet.

41. The method of claim 38 wherein the removing is performed by size screening.

42. The method of claim 30 wherein the dispensing is dispensing into a stream of grain associated with a harvesting machine.

43. The method of claim 42 wherein the dispensing is performed based on rate per area covered.

44. The method of claim 42 wherein the dispensing is performed based on rate per amount of grain flow.

45. A system for grain traceability, the system comprising:

a plurality of tracking devices for assisting in traceability of the grain, each of the tracking devices comprising (a) a plastic body, and (b) an RFID chip disposed within the plastic body;

a dispensing device configured to singulate and dispense each of the tracking devices into a flow of grain, wherein the dispensing device further comprises a metering device used to singulate and dispense each of the tracking devices into the flow of grain;

wherein an intelligent control is configured to control the dispensing device to dispense the plurality of tracking devices based on rate per area covered by a harvesting machine providing the flow of grain.

46. A system for grain traceability, the system comprising:

a plurality of tracking devices for assisting in traceability of the grain, each of the tracking devices comprising (a) a plastic body, and (b) an RFID chip disposed within the plastic body;

a dispensing device configured to singulate and dispense each of the tracking devices into a flow of grain;

wherein the dispensing device further comprises a metering device used to singulate and dispense each of the tracking devices into the flow of grain.

wherein the dispensing device is configured to dispense the plurality of tracking devices based on field location of a harvesting machine providing the flow of grain.

47. A method for tracing grain, the method comprising:

providing a plurality of tracking devices for assisting in traceability of the grain, each of the tracking devices comprising (a) a plastic body, and (b) an RFID chip disposed within the plastic body;

dispensing at least one of the plurality of tracking device into a stream of grain so as to associate identifying information with the stream of grain, wherein the dispensing is dispensing into a stream of grain associated with a harvesting machine, and wherein the dispensing is performed based on rate per area covered.

* * * * *

UNITED STATES PATENT AND TRADEMARK OFFICE

CERTIFICATE OF CORRECTION

PATENT NO. : 8,810,406 B2
APPLICATION NO. : 13/350240
DATED : August 19, 2014
INVENTOR(S) : Dennis Sell It is certified that error appears in the above-identified patent and that said Letters Patent is hereby corrected as shown below:

In the Claims

Col. 6, Claim 30, Line 63:
DELETE after RFID "chi storm"
ADD after RFID --chip storing--

Signed and Sealed this
Eleventh Day of November, 2014

Michelle K. Lee

Michelle K. Lee
*Deputy Director of the United States Patent and Trademark Office*